US009360272B2

(12) United States Patent
Hopkins

(10) Patent No.: US 9,360,272 B2
(45) Date of Patent: Jun. 7, 2016

(54) ADJUSTABLE BUTTSTOCK CLAMP

(71) Applicant: Sig Sauer, Inc., Newington, NH (US)

(72) Inventor: David B. Hopkins, Exeter, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 14/717,036

(22) Filed: May 20, 2015

(65) Prior Publication Data

US 2015/0338186 A1 Nov. 26, 2015

Related U.S. Application Data

(60) Provisional application No. 62/000,618, filed on May 20, 2014.

(51) Int. Cl.

| | |
|---|---|
| ***F41C 23/14*** | (2006.01) |
| ***F41C 23/20*** | (2006.01) |
| ***F41C 23/08*** | (2006.01) |
| ***F41C 23/04*** | (2006.01) |

(52) U.S. Cl.

CPC ..... *F41C 23/14* (2013.01); *F41C 23/04* (2013.01); *F41C 23/08* (2013.01); *F41C 23/20* (2013.01)

(58) Field of Classification Search

CPC ..... F41C 23/14
USPC ..... 42/73, 71.01
See application file for complete search history.

(56) References Cited

U.S. PATENT DOCUMENTS

| | | | | |
|---|---|---|---|---|
| 6,202,458 | B1 | 3/2001 | Buchalter | |
| 7,162,822 | B1 * | 1/2007 | Heayn | F41C 23/04 42/71.01 |
| 2009/0080968 | A1 | 3/2009 | Parrett et al. | |
| 2011/0192067 | A1 | 8/2011 | Troy | |
| 2012/0305041 | A1 | 12/2012 | Lah et al. | |

* cited by examiner

*Primary Examiner* — Reginald Tillman, Jr.
(74) *Attorney, Agent, or Firm* — Finch & Maloney PLLC

(57) ABSTRACT

An adjustable buttstock clamp for a rifle is disclosed which includes a cam lever having a mechanical locking feature configured to engage with a groove in a buttstock extension shaft when in the locked position. A buttstock recoil pad may be attached to an extension shaft that can telescope in and out of the body of the buttstock, allowing the user to adjust the length of pull of the rifle and angle of the recoil pad. In one embodiment, the shaft includes a number of grooves on its surface along the length of the shaft and the shaft is held in place using a band clamp that is activated by the cam lever. When the cam lever is in the locked position, the locking feature engages with one of the grooves of the shaft to hold the buttstock recoil pad at the desired length and angle.

18 Claims, 10 Drawing Sheets

ADJUSTABLE BUTTSTOCK CLAMP

RELATED APPLICATIONS

This application claims the benefit under 35 U.S.C. §119 (e) of U.S. Provisional Patent Application Ser. No. 62/000,618, filed May 20, 2014, which is incorporated herein by reference in its entirety.

FIELD OF THE DISCLOSURE

The disclosure relates to firearms and more particularly to features of an adjustable firearm buttstock.

BACKGROUND

Firearm design involves a number of non-trivial challenges, including the design of the firearm buttstock which is typically placed against a user's shoulder while firing. Considerations related to the design of a firearm buttstock may include, for example, the length of pull of the firearm.

SUMMARY

In one aspect, an adjustable buttstock clamp is provided. The adjustable buttstock clamp has at least two end portions, a cam lever and a locking feature. The cam lever may be configured to be operatively coupled to the at least two end portions and may pivot around a cam axle. The cam lever may include a camming surface configured to apply a clamping force on the at least two end portions when in a locked position. The locking feature may extend from the cam lever in a direction perpendicular to the cam axle. A portion of the locking feature may be configured to pass within an inner area of the band clamp when the cam lever is in the locked position. In some embodiments, the band clamp may be configured to receive a grooved extension shaft having an outer surface contoured to define a plurality of grooves at different points along the length of the grooved extension shaft. In some such embodiments, the locking feature may be configured to engage with one of the plurality of grooves when the cam lever is in the locked position. In these or other embodiments, the adjustable buttstock clamp may also include a leaf spring operatively coupled to the band clamp, and the outer surface of the band clamp may be contoured to define a slot or other type of perforation accessing the inner circumference. In some cases, a portion of the leaf spring is configured to pass through the perforation and within the inner circumference of the band clamp and to engage with one of the plurality of grooves. In various embodiments, the dimensions of the locking feature may be complementary to at least one of width and depth of the plurality of grooves. In some embodiments, the locking feature may be configured to apply a camming force against a portion of the grooved extension shaft when the cam lever is in the locked position. In some cases, the locking feature may be configured to engage with one of the plurality of grooves before the camming surface of the cam lever applies a significant clamping force on the at least two end portions, allowing the extension shaft to rotate around its axis while preventing the extension shaft from sliding along its axis. In further embodiments, the adjustable buttstock clamp also includes a grooved extension shaft. In some such embodiments, the buttstock recoil pad may be attached to a flange portion located at one end of the grooved extension shaft. In some embodiments, the adjustable buttstock clamp also includes a boss feature located at an end of the grooved extension shaft opposite the flange portion. In these or other embodiments, the band clamp is configured to be mounted within a cavity of a rifle buttstock and the grooved extension shaft is configured to telescope in and out of the rifle buttstock through the band clamp. In various embodiments, a firearm that includes an adjustable buttstock clamp as described herein is disclosed.

In another aspect, a cam lever is disclosed. The cam lever includes an eccentric camming portion configured to pivot around a cam axis, an eccentric camming surface on the eccentric camming portion configured to apply a clamping force on end portions of a band clamp when the eccentric camming portion is in a locked position, a cam lever handle extending from the eccentric camming portion, and a locking feature extending from the eccentric camming portion perpendicular to the cam axis. A portion of the locking feature may be configured to pass within an inner circumference of the band clamp when the eccentric camming portion is in a locked position. In some embodiments, the locking feature may be configured to engage with a groove of a grooved shaft passing through the band clamp when the eccentric camming portion is in the locked position. In some such embodiments, the grooved shaft may be a buttstock extension shaft configured to adjust at least one of a rifle's length of pull and a recoil pad angle of orientation. In various embodiments, the dimensions of the locking feature are determined based on at least one of the width and the depth of the groove of the grooved extension shaft.

In yet another aspect, an adjustable length rifle buttstock is provided. The adjustable length rifle buttstock includes a band clamp having at least two end portions, a buttstock body having an outer surface defining a cavity for receiving the band clamp, a buttstock extension shaft having a plurality of grooves around its circumference at different points along its length and defining a plurality of ridges between the plurality of grooves, a buttstock recoil pad attached to one end of the buttstock extension shaft, a cam lever operatively coupled to the at least two end portions and configured to apply a clamping force on the at least two end portions when the cam lever is in a locked position, and a locking feature extending from the cam lever in a direction perpendicular to a cam axis. The extension shaft may be configured to telescope in and out of the cavity through the band clamp. A portion of the locking feature may extend into one of the plurality of grooves when in the locked position and may remain clear of the plurality of ridges when in an unlocked position. In some embodiments, the outer surface of the buttstock body may be contoured to define a cam lever groove for receiving a handle portion of the cam lever when the cam lever is in the locked position. In these or other embodiments, a handle portion of the cam lever may conform to the outer surface of the buttstock body when the cam lever is in the locked position. In various other embodiments, a firearm that includes any of the adjustable length rifle buttstocks described herein is disclosed. In further embodiments, an adjustable length rifle buttstock is provided that allows a user to adjust at least one of the length of pull of the firearm and the buttstock recoil pad's angle of orientation by placing the cam lever in the locked position when the buttstock extension shaft is in a desired location.

The features and advantages described herein are not all-inclusive and, in particular, many additional features and advantages will be apparent to one of ordinary skill in the art in view of the drawings, specification and claims. Moreover, it should be noted that the language used in the specification has been selected principally for readability and instructional purposes and not to limit the scope of the inventive subject matter.

Figure 1A:
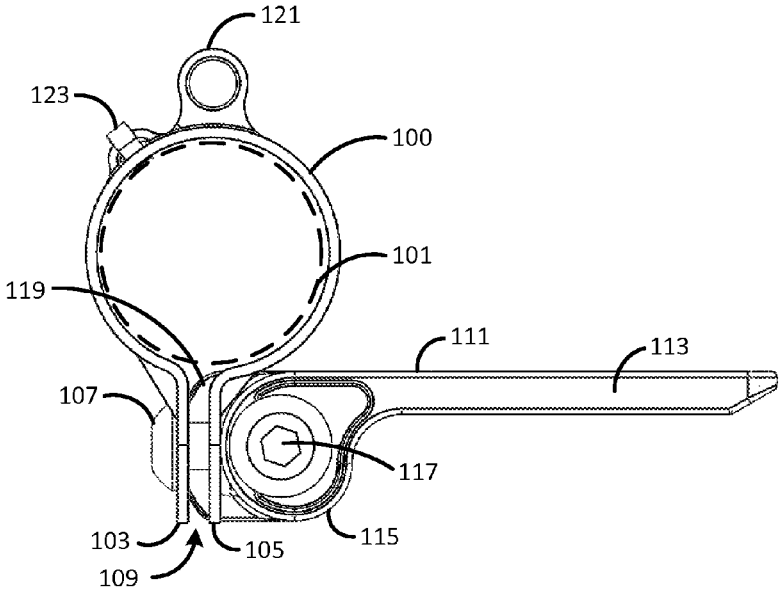
FIGS. 1A-B show an adjustable buttstock clamp with a cam lever in the unlocked position, in accordance with an embodiment of the present invention.

These and other features of the present embodiments will be understood better by reading the following detailed description, taken together with the figures herein described. In the drawings, each identical or nearly identical component that is illustrated in various figures may be represented by a like numeral. For purposes of clarity, not every component may be labeled in every drawing. Furthermore, as will be appreciated, the figures are not necessarily drawn to scale or intended to limit the claimed invention to the specific configurations shown.

DETAILED DESCRIPTION

An adjustable buttstock clamp for a rifle is disclosed. A buttstock recoil pad and/or buttplate may be attached to a buttstock extension shaft that can telescope in and out of the body of the buttstock, allowing the user to adjust the length of pull of the rifle. In one embodiment, the shaft includes a number of grooves on its surface along the length of the shaft. The buttstock clamp may be, for example, a band clamp activated by a cam lever and the cam lever may include a mechanical locking feature configured to engage with one of the grooves in a buttstock extension shaft when in the locked position. When the cam lever is in the unlocked position, the extension shaft can move in and out of the body of the buttstock. However, when the cam lever is in the locked position, the band clamp applies a compressive force around the extension shaft and the locking feature engages with one of the grooves of the shaft to mechanically hold the buttstock recoil pad at the desired length and angle.

General Overview

As previously indicated, there are a number of non-trivial issues related to the design and components associated with a firearm buttstock. One such issue is a firearm's length of pull, which is measured by the distance between the trigger and the end of the buttstock. When a rifle is held against a user's shoulder, the length of pull is an important factor in determining the comfort, fit and accuracy of the firearm. The ideal length of pull for each individual user may be determined by, for example, a user's body size, the thickness of clothing being worn, or whether the user is firing from a kneeling, standing, or prone position. Thus, some buttstocks include an extendable buttstock recoil pad which can adjust the firearm's length of pull and allow the firearm to be customized for various users and/or firing scenarios. In some cases, a buttstock recoil pad is attached to one end of an extendable shaft that can telescope in and out of the body of the buttstock. Such extendable recoil pads may be secured at the desired length using various clamps or fastening techniques. One such fastening technique involves a band clamp that is activated by a cam lever which compresses two ends of the clamp together and applies a compressive force around the telescoping shaft to hold it in place. The cam lever may include an eccentric camming portion that has an eccentric camming surface configured to pivot around a cam axis and clamp the ends of the band clamp when the lever is in the locked position. The band clamp may be housed and fastened within the body of the buttstock and a user can adjust the rifle's length of pull by setting the telescoping shaft to the desired location and locking the cam lever. However, such clamp devices may fail if the force applied by the cam lever is not strong enough to resist the forces applied to the buttstock while firing the rifle. This problem may occur particularly with machine guns where the system may become shock loaded beyond the clamping force applied by the cam lever.

Thus, in accordance with an embodiment of the present invention, an adjustable buttstock clamp is disclosed which is activated by a cam lever that includes an eccentric camming surface and a mechanical locking feature. The cam lever may rotate around a cam axis that is parallel to the buttstock extension shaft and the locking feature may be a tab or extension integral to the cam lever and extending perpendicular to the cam axis beyond the eccentric camming surface. In one embodiment, the adjustable buttstock clamp is a band clamp, and when the cam lever is in the locked position a portion of the cam lever's locking feature is configured to pass within the area defined by the band portion of the band clamp. In some embodiments, the band clamp may be mounted within a rifle buttstock. A buttstock recoil pad may be attached to one end of an extension shaft that is configured to pass through the band clamp and telescope in and out of the body of the rifle buttstock, allowing a user to adjust the length of pull of the rifle. In one such embodiment, the buttstock extension shaft includes a number of grooves on its surface at different points along the length of the shaft and a portion of the cam lever locking feature is configured to engage with one of these grooves when the cam lever is in the locked position. The width and/or length of the locking feature may be complementary to the width and/or depth of the grooves of the extension shaft, in some embodiments.

In one embodiment, the dimensions of the camming surface and locking feature are designed such that when the cam lever is in the unlocked position little or no clamping force is applied to the ends of the band clamp and the locking feature does not engage with the grooves of the extension shaft. However, when the cam lever is placed in the locked position, the eccentric camming surface compresses the ends of the band clamp together, thus applying a compressive force around the surface of the extension shaft, while the locking feature of the cam lever mechanically engages with a groove on the extension shaft. Thus, the adjustable buttstock clamp acts as a traditional band clamp while also mechanically locking the shaft in axial translation via the mechanical interference of the cam lever locking feature with one of the grooves of the extension shaft. In such an embodiment, if the clamping force is not sufficient to resist movement of the shaft or if the system becomes shock loaded beyond the clamping force, which can occur repeatedly in a rifle, the mechanical locking feature prevents the shaft from sliding along its axis. The grooves of the extension shaft may be parallel circular grooves positioned along the length of the shaft and defining a plurality of parallel ridges between them. The grooves may be of equivalent size and may be equally spaced from each other along the length of the shaft. In many embodiments the grooves and ridges may be of constant dimensions around the circumference of the shaft while in other embodiments the width or depth of a groove may vary. In some embodiments, the grooves may have a width greater than 1 mm, 2 mm, or 3 mm, and the width of the ridges may be greater than 1 mm, 2 mm, or 3 mm. Likewise, the depth of the grooves may be greater than 1 mm, 2 mm, or 3 mm, in some embodiments.

In one specific example, the band clamp is mounted within a cavity in the body of the rifle buttstock and the extension shaft is configured to telescope in and out of the cavity in the buttstock through the center of the band clamp. The cam lever may engage with the end portions of the band clamp via a substantially cylindrical barrel nut and one or more screws or fasteners. In one such example, the cam lever includes a pivot slot or groove for receiving the barrel nut and allowing the cam lever to pivot around the cam axis. The cam lever may be coupled to the barrel nut by a screw or other fastener that passes through the cam lever along the cam axis and through the diameter of the barrel nut. This fastener may act as the rotational axle around which the cam lever can pivot. In one embodiment, an adjustment screw passes through the end portions of the band clamp and attaches to the barrel nut at a threaded hole that passes through a portion of the axis of the barrel nut. In such an embodiment, the end portions of the band clamp are compressed between the head of the adjustment screw and the eccentric camming surface of the cam lever. The amount of clamping force applied by the cam lever may depend, among other factors, on the dimensions of the eccentric camming surface and the length of the adjustment screw. In some cases, the degree to which the adjustment screw is threaded into the barrel nut can adjust the clamping force applied by the cam lever, thus allowing for a larger range of clamping and retention of the extension shaft into a buttstock. The locking feature of the cam lever may extend from one or more sides of the cam lever perpendicular to the cam axis, such that it is not obstructed by the body of the band clamp or the end portions of the band clamp when the cam lever pivots around the cam axle, in some embodiments. Thus, when the cam lever pivots into the locked position, a portion of the locking feature may pass within one of the grooves of the extension shaft creating a mechanical interference that prevents the shaft from telescoping in or out of the band clamp.

In some embodiments, the dimensions of the locking feature may depend on the thickness and/or depth of the grooves along the surface of the extension shaft, or whether the locking feature is intended to apply a camming pressure to the extension shaft. For example, the locking feature may extend farther away from the cam axis or be shaped as a plate cam if the grooves of the extension shaft are deep, or if the locking feature is intended to apply a camming force to the extension shaft when in the locked position. In another embodiment, the dimensions of the locking feature and/or the eccentric camming surface of the cam lever allow it to engage with the grooves of the extension shaft in an intermediate locked position between the fully unlocked position and the locked position. In such an intermediate locked position, the locking feature of the cam lever may engage within one of the grooves of the extension shaft before the eccentric camming surface applies a significant amount of pressure against the end portions of the band clamp. Thus, the locking feature prevents the extension shaft from telescoping in and out of the band clamp while still allowing the extension shaft to rotate around its axis. In other embodiments, the band clamp may include an indexer coupled to the outside of the band clamp. The indexer may be configured to align the locking feature of the cam lever with one of the grooves of the extension shaft. In one such embodiment, a portion of the indexer may extend through a slot in the surface of the band clamp and engage with one of the grooves of the extension shaft, such that when the indexer is engaged the locking feature aligns with one of the grooves rather than the ridges of the extension shaft. The distance along the axis of the extension shaft between the locking feature and the portion of the indexer that engages with the grooves of the extension shaft may correspond to a multiple of the distance between grooves. Thus, in this embodiment, when the indexer is aligned with a groove the locking feature is also aligned with a groove. In some embodiments, the indexer may be a leaf spring.

In some embodiments, the band clamp and a portion of the cam lever may be housed within the body of a rifle's buttstock and a mounting feature may extend from the band clamp for mechanically fastening the clamp within the buttstock using a screw, bolt, or other fastening device. In such embodiments, the buttstock includes a cavity into which the band clamp may be fastened, and the extension shaft may telescope in and out of the cavity to adjust the length of pull of the rifle. The extension shaft may also include a flange portion at one end of the shaft for attaching a buttstock recoil pad and a boss feature at the opposing end of the shaft. The boss feature may have a larger diameter than the main body of the extension shaft, and in some embodiments will engage with the body of the band clamp when the extension shaft is fully extended. Thus, the boss feature may provide a positive stop when the shaft is fully extended and prevent the extension shaft from being pulled out of the buttstock during operation.

The handle portion of the cam lever may fit within a groove or contour on the outer surface of the buttstock when the cam lever is in the locked position, in some embodiments. The handle portion of the cam lever may be straight or curved, in various embodiments, and may conform to the outer surface of the buttstock when in the locked position. In one specific example, the cam lever may be configured to pivot between an unlocked position where the lever handle is oriented substantially perpendicular to the surface of the buttstock body, and a locked position, where the lever handle is oriented downward (toward the toe of the buttstock). In another example, the cam lever handle may be oriented upwards (toward the comb of the buttstock) and locked by pushing it into an upward facing locked position. In still other embodiments, when in the unlocked position the cam lever may rotate freely around the axis of the adjustment screw and may lock in either an upward or a downward facing position.

Although the various embodiments described herein are shown with a cylindrical band clamp having only two end portions and a cam lever with a single locking feature on one side of the eccentric camming surface, the adjustable buttstock clamp and cam lever are not intended to be limited to any particular shape or design. For example, in various embodiments the cam lever may include two locking features, one on each side of the eccentric camming surface extending perpendicular to the cam axle. In another embodiment, the locking feature is configured to pass within the inner area of the band clamp and engage with a groove on the extension shaft by passing through a slot in the band clamp rather than to one side of the band clamp. In another embodiment, the locking feature is configured to also provide a camming force against the extension shaft when in the locked position. The band clamp, in cross section, can be, for example, circular, oval, polygonal or some combination thereof. In many embodiments, the band clamp is shaped to complement the outer dimensions of the extension shaft so that there is maximum surface area interaction between the two parts when the band clamp is in a locked position.

In other embodiments, the indexer or index spring may be integrated with the band clamp, such that it is a flexible feature of the clamp that acts upon the same principle of a spring band clamp. In one such embodiment, the indexer engages the grooves of the extension shaft and is properly spaced within the dimensions of the band clamp body to allow the locking feature of the cam lever to engage with the grooves of the extension shaft without being obstructed by the band clamp body. The body of the band clamp may have one or more slots to form a finger-like spring, in some embodiments. In other embodiments the inner surface of the band clamp may include a protrusion that acts as an indexer. The extension shaft may have a larger diameter at its forward end, in some embodiments, to provide a mechanical stop when the extension shaft is fully extended. The boss feature may have a larger diameter than the rest of the extension shaft but smaller than the inner diameter of the band clamp. In some embodiments the boss feature may be an external snap ring or other similar feature applied to the end of the extension shaft.

Numerous other configurations and variations will be apparent in light of this disclosure. The adjustable buttstock clamp may be implemented in various rifles (e.g., the SIG516® rifle) and various machine/submachine guns (e.g., the SIG MPX™ submachine gun), just to name a few firearm examples (note that the specific firearm examples provided are all produced by Sig Sauer, Inc.). However, the clamping techniques variously disclosed herein are not intended to be limited for use with any particular firearm, unless otherwise indicated.

Adjustable Buttstock Clamp Examples

Figure 1B:
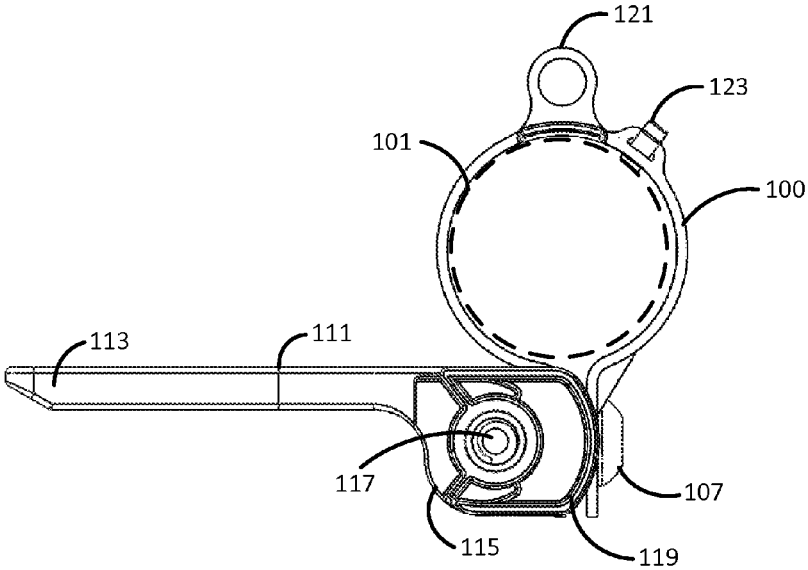

FIGS. 1A-B show an adjustable buttstock clamp with a cam lever in the unlocked position, in accordance with an embodiment of the present invention. FIG. 1A is a view of the adjustable buttstock clamp looking down the center of the band clamp, while FIG. 1B shows the adjustable buttstock clamp along the same axis, 180° opposed to the view in FIG. 1A. As can be seen in these example figures, the clamp 100 is a band clamp that defines an inner area 101. In some embodiments, the band clamp 100 includes two planar end portions 103 and 105 which each include a passageway for receiving the stem of an adjustment screw or fastener 107. In this particular embodiment, the head of the adjustment screw 107 engages with the first band clamp end portion 103 and passes through a space 109 between the end portions 103 and 105 before coupling with a cam lever 111 via a barrel nut (not shown) which is housed within the cam lever 111. The cam lever 111 may include, for example, a handle portion 113, a locking feature 119, and an eccentric camming surface 115 that is configured to apply a clamping force on the end portions 103 and 105 when the lever is in the locked position. The cam lever 111 can engage with the barrel nut via a cam axle 117 which passes through the cam lever 111 and allows it to pivot around the cam axis. The adjustable buttstock clamp also includes, in this particular embodiment, a mounting feature 121 for mechanically fastening the clamp within a rifle buttstock using a screw, bolt, or other fastener. In this example, an indexer 123 is also included, which will be described in greater detail in reference to FIG. 5 below. As shown in this example, when the cam lever 111 is in the unlocked position, the camming surface 115 does not engage with the end portion 105 and the locking feature 119 does not pass within the inner area 101.

Figure 2B:
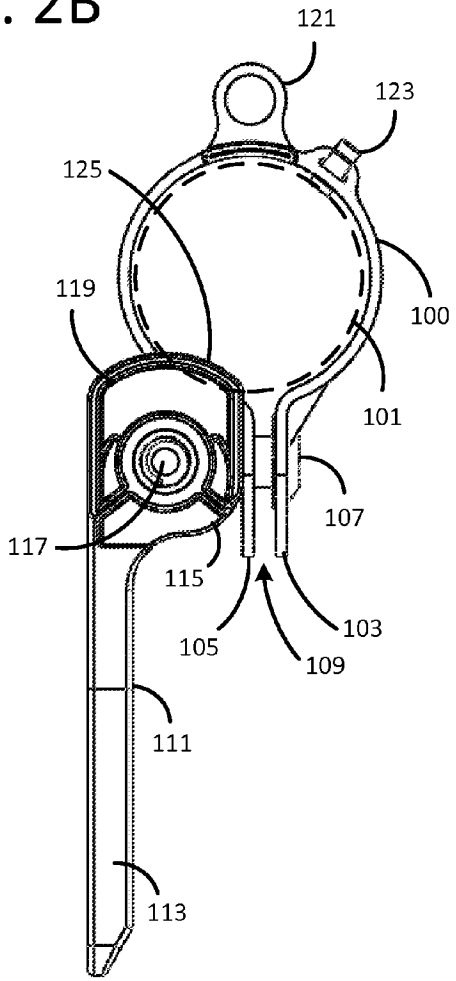
FIGS. 2A-D show the adjustable buttstock clamp of FIGS. 1A-B with the cam lever in a locked position, in accordance with an embodiment of the present invention.
Figure 2A:
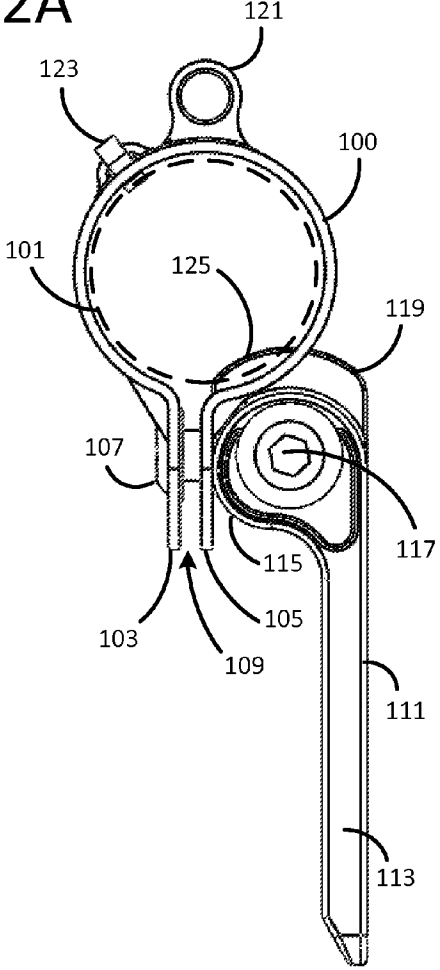

FIGS. 2A-D show an adjustable buttstock clamp with a cam lever in the locked position, in accordance with an embodiment of the present invention. FIG. 2A is a view of the adjustable buttstock clamp looking down the center of the band clamp, while FIG. 2B shows the adjustable buttstock clamp along the same axis, 180° opposed to the view in FIG. 2A. As can be seen, a band clamp 100 includes two end portions 103 and 105 and defines an inner area 101. An adjustment screw or fastener 107 passes through the end portions 103 and 105 and engages with the cam lever 111 via a barrel nut (not shown) which is housed within the cam lever 111. The cam lever 111 engages with the barrel nut via a cam axle 117 which passes through the cam axis of the cam lever 111 and allows the cam lever 111 to pivot around the cam axis. As can be further seen in this example, the cam lever 111 includes an eccentric camming surface 115 and a locking feature 119 which extends perpendicular to the cam axis along one side of the cam lever 111. In this particular example, the cam lever 111 is in the locked position and the camming surface 115 is applying a rotational force against the band clamp end portion 105 and a portion 125 of the locking feature 119 passes within the inner area 101 of the band clamp 100. As will be appreciated, when the cam lever 111 is in the locked position, the eccentric camming surface 115 applies a clamping force on the end portions 103 and 105 of a band clamp 100, thus decreasing or eliminating the space 109 between the end portions 103 and 105 and decreasing the size of the inner area 101 of the band clamp 100. As discussed above, the band clamp 100 may be used as an adjustable buttstock clamp for holding a buttstock extension shaft in place. In such an embodiment, the extension shaft may be configured to telescope in and out of the body of the buttstock and may be attached to a buttstock recoil pad at one end of the shaft. The band clamp 100 may be housed within the body of the buttstock, in some embodiments, and the extension shaft may pass through the band clamp 100. The adjustable buttstock clamp also includes, in this particular embodiment, an indexer 123 and a mounting feature 121. The mounting feature 121 may be used, in some embodiments, for mechanically fastening the clamp within a rifle buttstock using a screw, bolt, or other fastener. The amount of compression applied by the band clamp 100 around the extension shaft may depend, among other factors, on the dimensions of the eccentric camming surface 115 and the length of the adjustment screw 107. In some embodiments, the clamping force applied by the cam lever 111 can be adjusted by threading the adjustment screw 107 more or less into the barrel nut of the cam lever 111, thus allowing for a larger range of clamping and retention of the extension shaft into a buttstock.

Figure 2D:
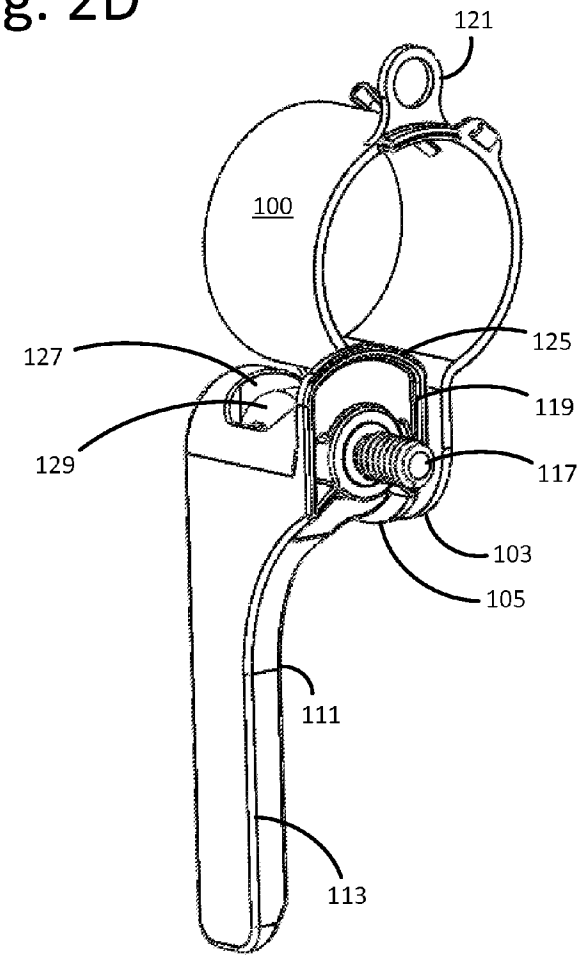
Figure 2C:
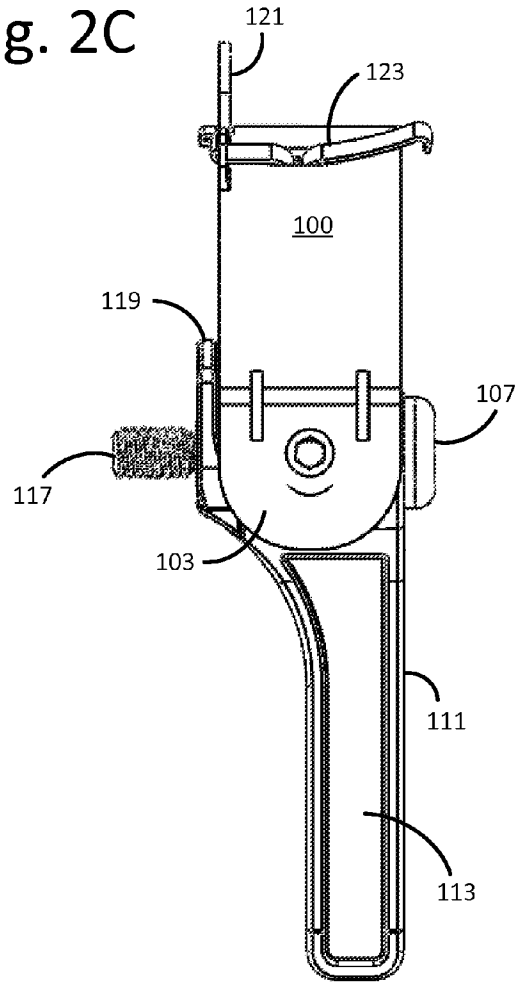

FIG. 2C is a view of the adjustable buttstock clamp looking perpendicular to the cam axle 117 with the locking feature 119 in the locked position. As can be seen in this figure, the locking feature 119 extends perpendicular to the cam axle 117 and is not obstructed by the band clamp 100 or the end portions 103 and 105 when it pivots around the cam axle 117. FIG. 2D is an isometric view of the adjustable buttstock clamp showing the locking feature 119 in the locked position and passing to one side of the band clamp 100. From this particular angle, a slot or groove 127 can be seen within the cam lever 111, which is configured to receive a barrel nut 129 and allow the cam lever 111 to pivot around the cam axis. In this example, the cam lever 111 engages with the barrel nut 129 via a cam axle 117 which defines the cam axis around which the cam lever 111 can pivot. The cam axle 117 is configured to pass through the diameter of the barrel nut 129, in this particular embodiment, and an adjustment screw or fastener 107 (visible in FIGS. 2A-C) is configured to engage with the barrel nut 129 perpendicular to the cam axle 117. In some embodiments, the cam axle 117 and/or adjustment screw 107 may be implemented with a threaded screw, partially threaded screw, rivet, bolt, pin, or other fastening device. In other embodiments, the cam lever 111 can engage with the end portions 103 and 105 of the band clamp 100 using fewer or more elements. The present disclosure is not intended to be limited to any particular means of connecting a cam lever to end portions of a clamp.

Figure 3A:
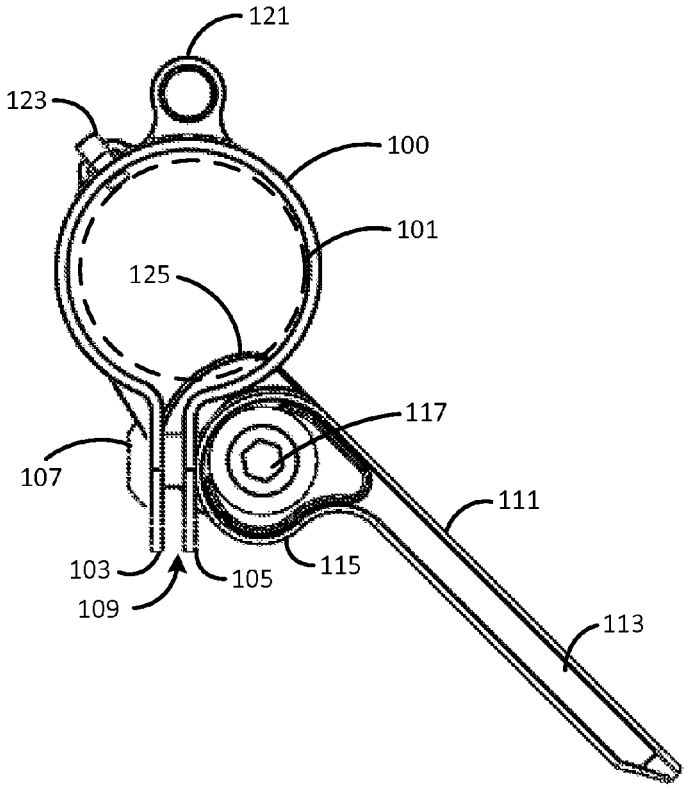
FIGS. 3A-B show the adjustable buttstock clamp of FIGS. 1A-B with the cam lever in an intermediate locked position, in accordance with an embodiment of the present invention.
Figure 3B:
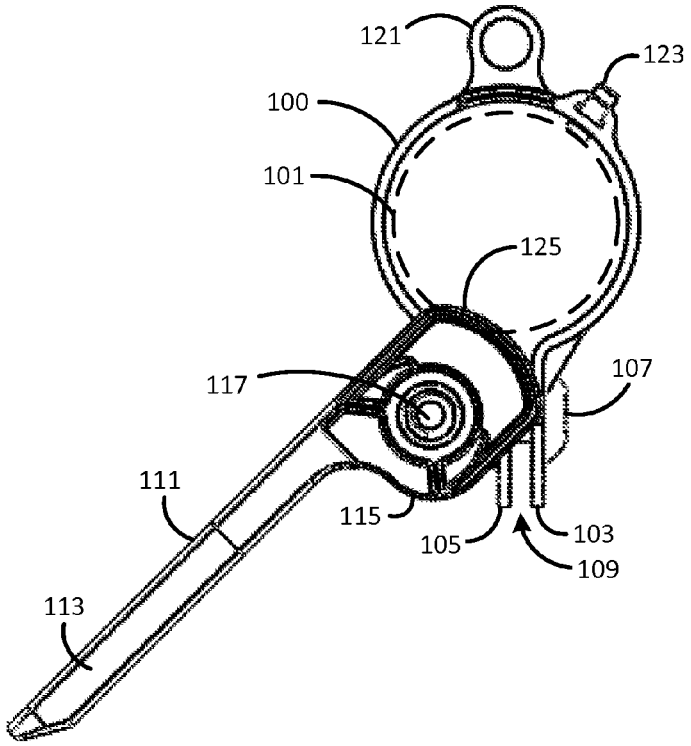

FIGS. 3A-B show an adjustable buttstock clamp with a cam lever in an intermediate locked position, in accordance with an embodiment of the present invention. FIG. 3A is a view of the adjustable buttstock clamp looking down the center of the band clamp, while FIG. 3B shows the adjustable buttstock clamp along the same axis, 180° opposed to the view in FIG. 3A. In an intermediate locked position, a portion of the locking feature 119 may pass within the inner area 101 of the band clamp 100 before the eccentric camming surface 115 applies a significant amount of pressure against the end portions 103 and 105.

Figure 4:
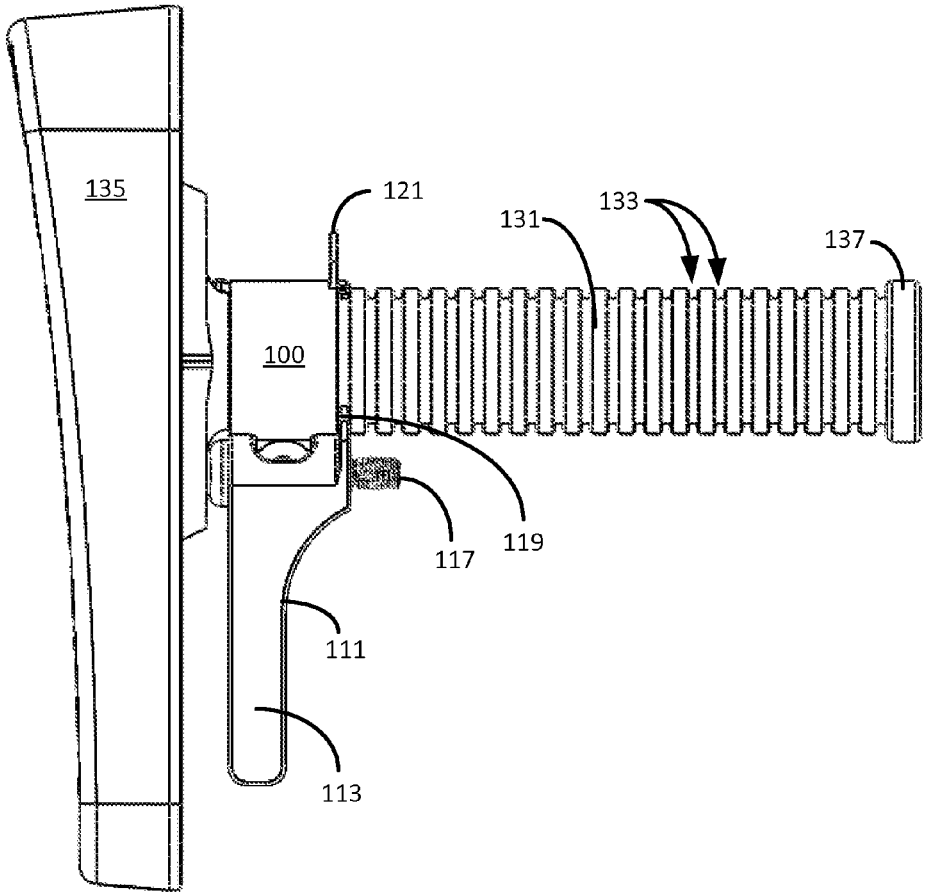
FIG. 4 shows the adjustable buttstock clamp of FIGS. 1A-B around a buttstock extension shaft, in accordance with an embodiment of the present invention.

FIG. 4 shows an adjustable buttstock clamp around a buttstock extension shaft, in accordance with an embodiment of the present invention. In this embodiment, the adjustable buttstock clamp is a band clamp 100 which is activated by a cam lever 111. The band clamp 100 may be wrapped around a buttstock extension shaft 131 which includes a buttstock recoil pad 135 at one end, a boss feature 137 at the opposing end and a number of grooves 133 on its outer surface along the length of the shaft 131. The cam lever may include a handle portion 113, and a locking feature 119 that is configured to engage with one of the grooves 133 when the cam lever 111 is in a locked position. In one embodiment, when the cam lever 111 is in the locked position, the eccentric camming surface (not shown) may tighten the band clamp 100 around the extension shaft 131 while the locking feature 119 engages with one of the grooves 133 and provides a mechanical lock to prevent the shaft 131 from passing through the band clamp 100. As shown in this embodiment, the locking feature 119 of the cam lever 111 extends perpendicular to the cam axle 117 and is not obstructed by the band clamp 100 when the cam lever 111 pivots around the cam axle 117. In some embodiments, the dimensions of the locking feature 119 may depend on the thickness and/or depth of the grooves 133. In other embodiments, the dimensions of the locking feature 119 and/or the eccentric camming surface 115 allow the cam lever 111 to engage with the extension shaft 131 in an intermediate locked position (shown in FIGS. 3A-B) between the unlocked position and the locked position. In such an intermediate locked position, a portion of the locking feature 119 may pass within one of the grooves 133 before the eccentric camming surface 115 applies a significant amount of pressure against the end portions 103 and 105 of the band clamp 100. This allows the extension shaft 131 to rotate around its axis while preventing it from telescoping in and out of the band clamp 100. In this particular embodiment, the boss feature 137 has a larger diameter than the main body of the extension shaft 131, thus providing a positive stop when extending the shaft 131 out of the band clamp 100. When fully extended, the boss feature 137 engages with the band clamp 100, which may be fastened into a rifle buttstock via a mounting feature 121, and ensures that the extension shaft 131 is not removed from a rifle buttstock during operation.

Figure 5:
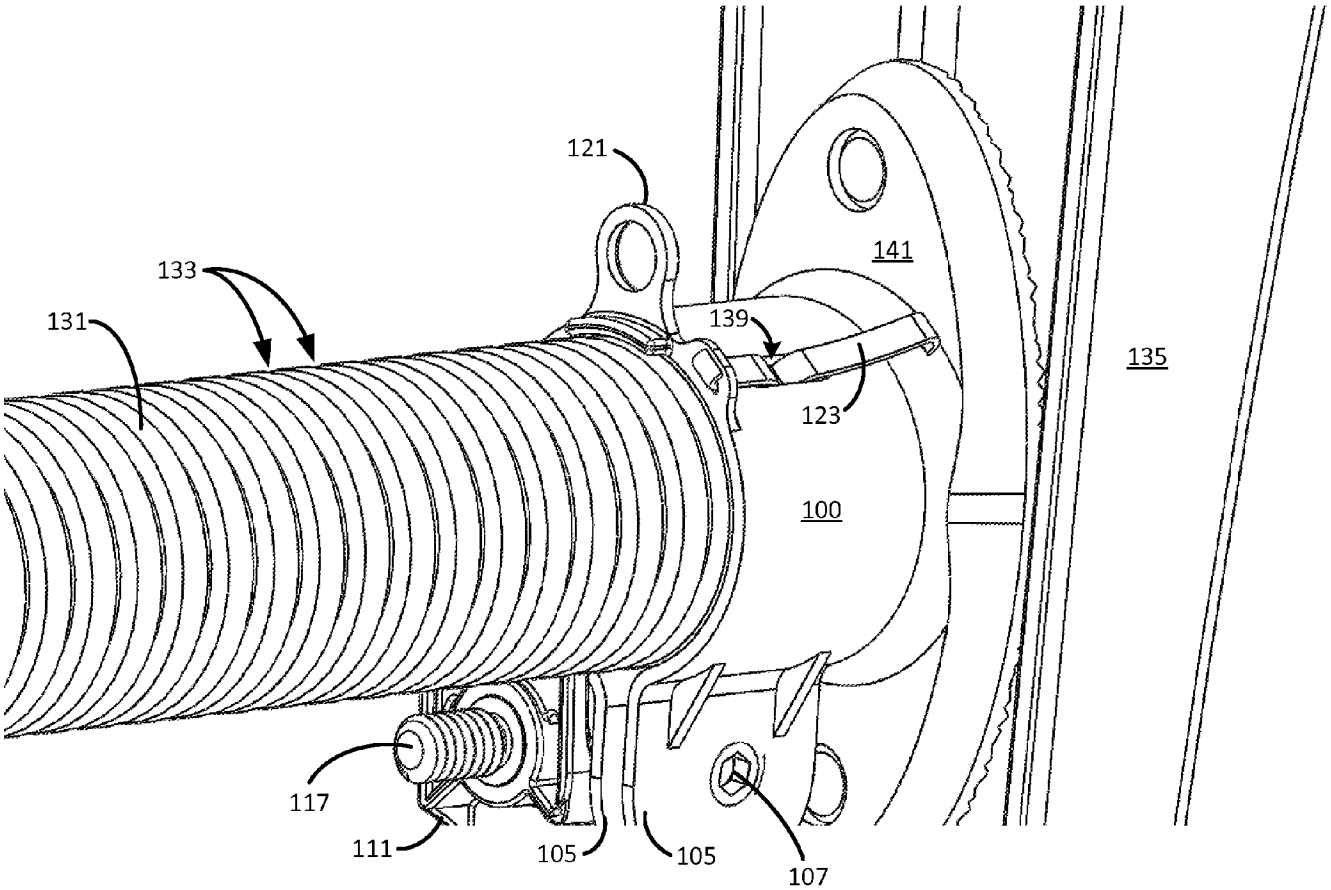
FIG. 5 shows the adjustable buttstock clamp of FIGS. 1A-B with an indexer, in accordance with an embodiment of the present invention.

FIG. 5 shows an adjustable buttstock clamp with an indexer, in accordance with another embodiment of the present invention. The adjustable buttstock clamp, in this embodiment, is a band clamp 100 which is activated by a cam lever 111. The band clamp 100, in this embodiment, is wrapped around an extension shaft 131 which includes a number of grooves 133 along the length of the shaft 131. In this embodiment, the band clamp 100 includes a slot 139 which is configured to receive a portion of the indexer 123. A portion of the indexer may extend through the slot 139 and engage with one of the grooves 133 of the extension shaft 131. The indexer 123, in this particular example, is a leaf spring and functions to index the grooves 133 of the extension shaft 131 such that the locking feature 119 of the cam lever 111 aligns properly with the grooves 133. The indexer 123 may also provide tactile and/or aural feedback as the extension shaft 131 is slid through the band clamp 100 and the indexer 123 engages with the various grooves 133 of the extension shaft 131. The extension shaft 131, in this example, also includes a flange portion 141 at one end which is connected to a buttstock recoil pad 135.

Figure 6:
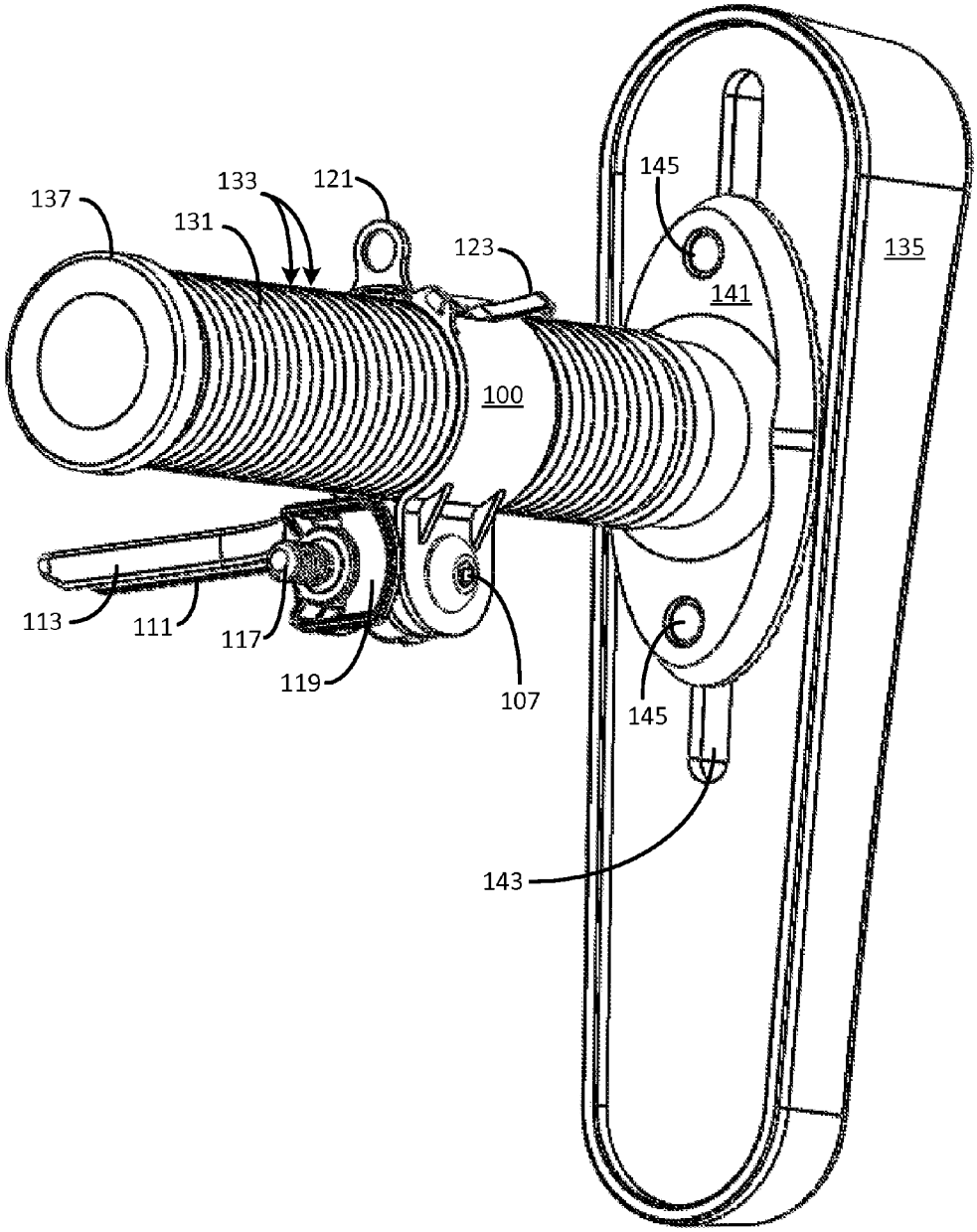
FIG. 6 shows the adjustable buttstock clamp of FIGS. 1A-B around a buttstock extension shaft with the cam lever in the unlocked position, in accordance with an embodiment of the present invention.

FIG. 6 shows an adjustable buttstock clamp around a buttstock extension shaft where the cam lever is in the unlocked position, in accordance with an embodiment of the present invention. As can be seen, the locking feature 119 of the cam lever 111 does not engage with any of the grooves 133 of the extension shaft 131 when in the unlocked position. In this embodiment, the extension shaft 131 includes a flange portion 141 at one end which is attached to a buttstock recoil pad 135 to allow for vertical adjustment of the recoil pad 135. In this particular example, the buttstock recoil pad 135 includes a sliding channel 143 and the flange portion 141 includes holes 145 that will line up with the channel 143. The holes 145 may be threaded, in one example, and a screw or other fastening device can pass through the channel 143 and engage with the threaded holes 145. Thus, the buttstock recoil pad 135 may slide up and down along the channel 143, and a fastening device may tighten to set the recoil pad 135 in the desired position.

Figure 7:
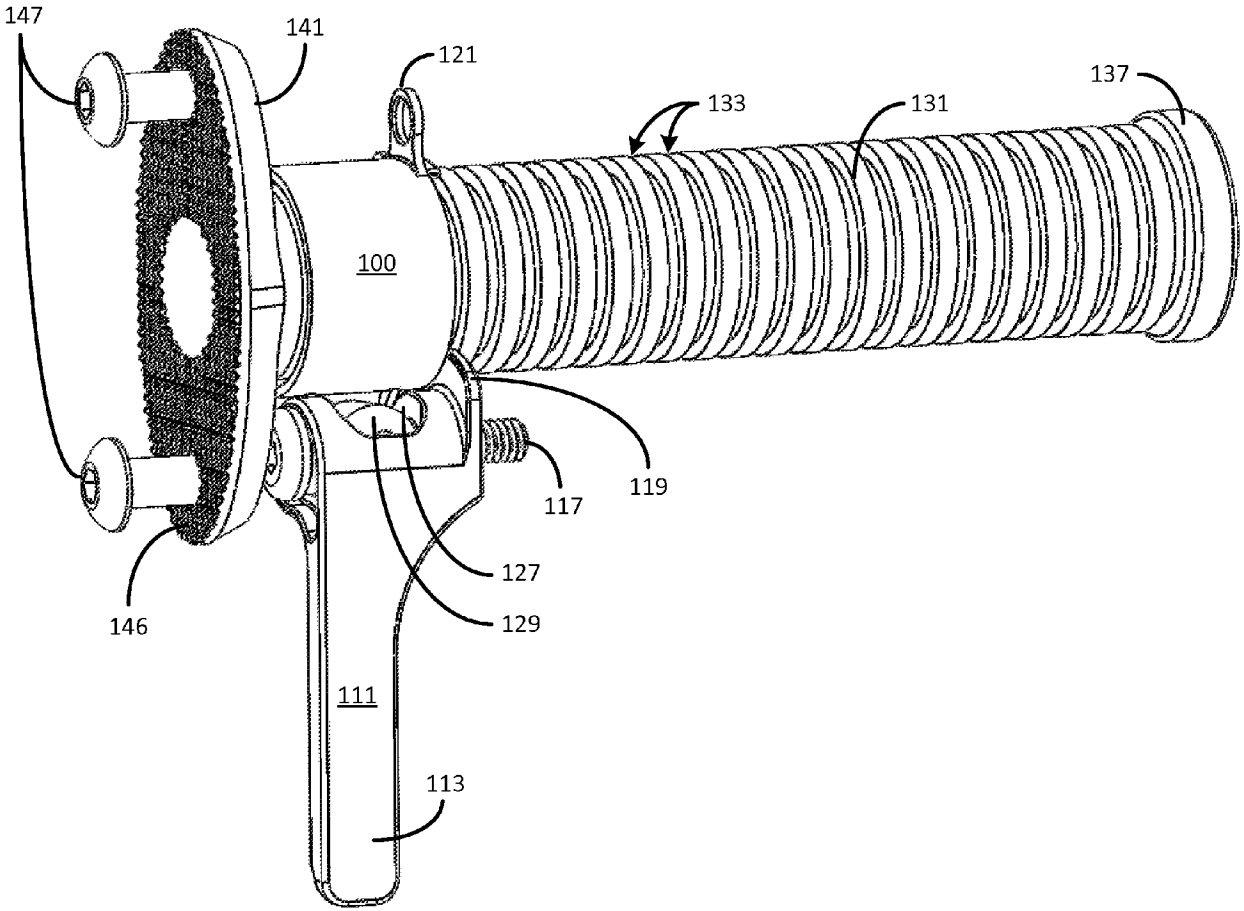
FIG. 7 shows the adjustable length buttstock clamp of FIGS. 1A-B around a buttstock extension shaft having a flange portion, according to an embodiment of the present invention.

FIG. 7 shows an adjustable buttstock clamp around a buttstock extension shaft, in accordance with an embodiment of the present invention. In this embodiment, the extension shaft 131 includes a flange portion 141 at one end, and the flange portion 141 has a knurled surface 146 opposed to the shaft. In this particular example, two fasteners 147 engage with the threaded holes 145 of the flange portion 141 and may pass through the channel 143 of a buttstock recoil pad 135, as described in FIG. 6. In such an example, the fastener heads have a diameter greater than the width of the channel 143, and when the fasteners 147 are tightened the knurled surface 146 of the flange portion 141 can hold a buttstock recoil pad in the desired vertical position. In some embodiments, the fasteners 147 may be screws with a drive feature in each screw head, or cam bolts, or other suitable fastening devices.

Figure 8:
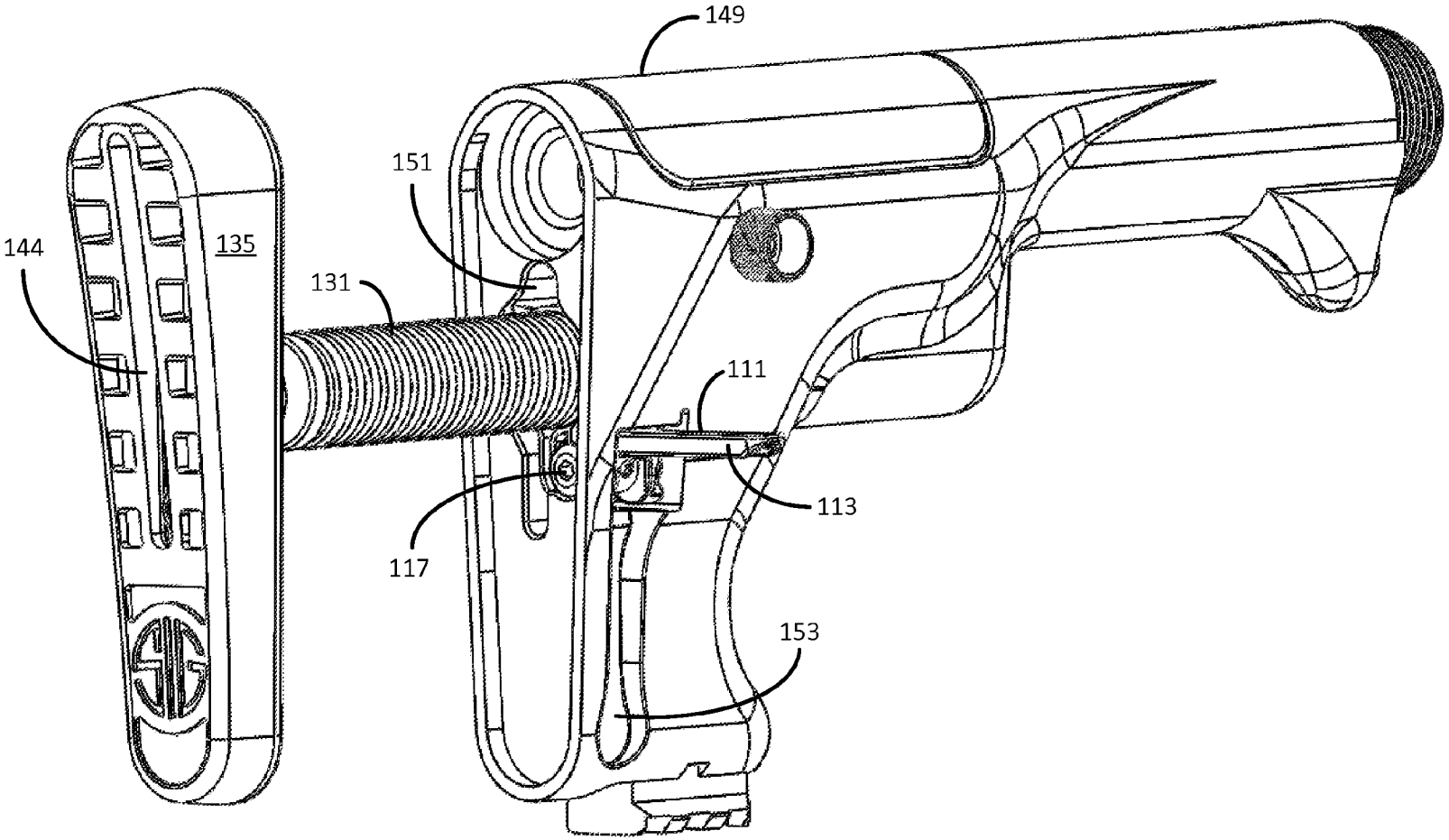
FIG. 8 shows an adjustable length rifle buttstock with an extension shaft and unlocked cam lever, according to an embodiment of the present invention.

FIG. 8 shows an adjustable length buttstock with an extension shaft and cam lever, according to an embodiment of the present invention. The cam lever 111 shown in FIG. 8 is in the unlocked position with the handle portion 113 lifted away from the surface of the buttstock 149. In this embodiment, a buttstock recoil pad 135 is attached to an extension shaft 131 which can telescope in and out of the buttstock 149 within a cavity 151. The recoil pad 135 may include an access channel 144 corresponding to channel 143 (shown in FIG. 6) that allows a user to access fasteners 147 (shown in FIG. 7). The band clamp 100, in this embodiment, is fastened within the cavity 151 and surrounds a portion of the extension shaft 131. The cam lever 111 can pivot around a cam axle 117, in this example, and when in the unlocked position, the locking feature 119 on the cam lever 111 does not engage with the grooves 133 of the extension shaft 131 and the extension shaft 131 is free to telescope in and out of the buttstock 149 and rotate around its axis. The end portions 103 and 105 of the band clamp 100, the cam axle 117, and the portion of the cam lever 111 which contacts end portion 105 may also be housed within cavity 151, and the mounting feature 121 may be used to mechanically fasten the band clamp 100 to the buttstock 149, as described above. In some embodiments, the buttstock 149 includes a cam lever groove 153 configured to receive the handle portion 113 when the cam lever 111 is in the locked position.

Figure 9:
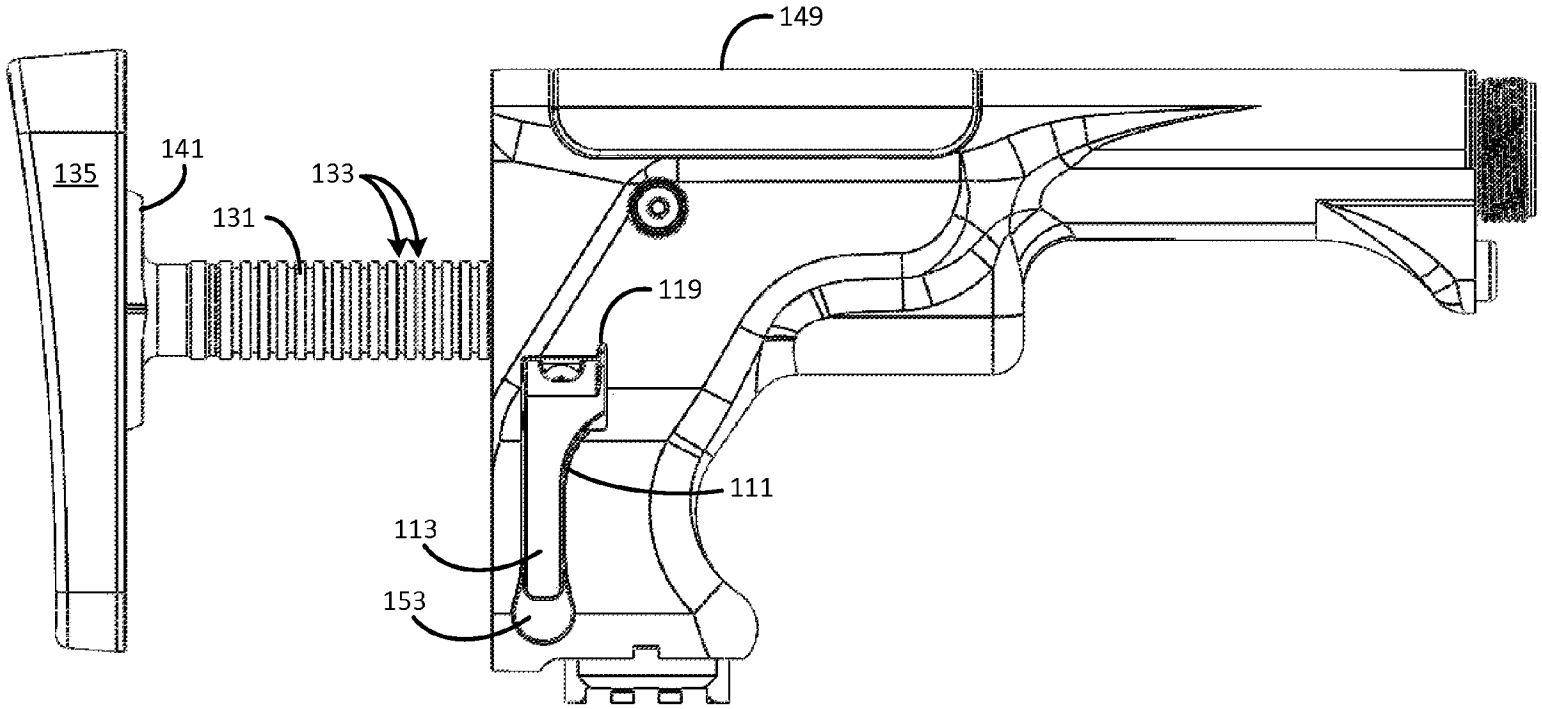
FIG. 9 shows an adjustable length rifle buttstock with an extension shaft and locked cam lever, according to an embodiment of the present invention.

FIG. 9 shows an adjustable length buttstock with an extension shaft and cam lever, according to another embodiment of the present invention. The cam lever 111 shown in FIG. 9 is in the locked position and the handle portion 113 lies within a cam lever groove 153 within the buttstock 149. In some embodiments, the handle portion 113 may conform to the surface of the buttstock 149. Alternatively, the handle portion may be countersunk within the groove 153 when in the locked position. While in the locked position, the locking feature 119 of the cam lever 111 engages with one of the grooves 133 of the extension shaft 131, holding the buttstock recoil pad 135 at the desired length.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The indefinite articles "a" and "an" as used herein in the specification and in the claims, unless clearly indicated to the contrary, should be understood to mean "at least one."

The phrase "and/or" as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. An adjustable buttstock damp comprising:

a band damp with at least two end portions;

a cam lever configured to be operatively coupled to the at least two end portions, the cam lever comprising:

an eccentric camming portion configured to pivot around a cam axis; an eccentric camming surface on the eccentric camming portion configured to apply a clamping force on the least two end portions when in a locked position;

a cam lever handle extending from the eccentric camming portion; and a locking feature extending from the eccentric camming portion in a direction perpendicular to the cam axle axis, wherein a portion of the locking feature is configured to pass within an inner area of the band clamp when the eccentric camming portion is in the locked position, wherein dimensions of the locking feature are complementary to at least one of width and depth of a plurality of grooves of a buttstock shaft.

2. The adjustable buttstock clamp of claim 1, wherein the band clamp is configured to receive a grooved extension shaft having an outer surface contoured to define a plurality of grooves at different points along a length of the grooved extension shaft, and wherein the locking feature is configured to engage with one of the plurality of grooves when the eccentric camming portion is in the locked position.

3. The adjustable buttstock clamp of claim 2, further comprising a leaf spring operatively coupled to the band clamp, wherein an outer surface of the band clamp is contoured to define a slot accessing an inner circumference of the band damp and a portion of the leaf spring is configured to pass through the slot and within the inner circumference of the band clamp and to engage with one of the plurality of grooves.

4. The adjustable buttstock damp of claim 2, wherein the locking feature is further configured to apply a camming force against a portion of the grooved extension shaft when the eccentric camming portion is in the locked position.

5. The adjustable buttstock damp of claim 2, wherein the locking feature is configured to engage with one of the plurality of grooves before the eccentric camming surface of the cam lever applies a significant clamping force on the at least two end portions, allowing the extension shaft to rotate around its axis while preventing the extension shaft from sliding along its axis.

6. The adjustable buttstock clamp of claim 2, further comprising the grooved extension shaft.

7. The adjustable buttstock clamp of claim 6, wherein a buttstock recoil pad is attached to a flange portion located at one end of the grooved extension shaft.

8. The adjustable buttstock clamp of claim 7, further comprising a boss feature located at an end of the grooved extension shaft opposite the flange portion.

9. The adjustable buttstock clamp of claim 8, wherein the band damp is configured to be mounted within a cavity of a rifle buttstock, and the grooved extension shaft is configured to telescope in and out of the rifle buttstock through the band damp.

10. A firearm including the adjustable buttstock clamp of claim 1.

11. A cam lever comprising:

an eccentric camming portion configured to pivot around a cam axis;

an eccentric camming surface on the eccentric camming portion configured to apply a clamping force on end portions of a band clamp when the eccentric camming portion is in a locked position;

a cam lever handle extending from the eccentric camming portion; and a locking feature extending from the eccentric camming portion perpendicular to the cam axis, and wherein a portion of the locking feature is configured to pass within an inner circumference of the band clamp when the eccentric camming portion is in a locked position, wherein dimensions of the locking feature are determined based on at least one of width and depth of a groove of a grooved extension shaft of a buttstock shaft.

12. The cam lever of claim 11, wherein the locking feature is configured to engage with a groove of a grooved shaft passing through the band damp when the eccentric camming portion is in the locked position.

13. The cam lever of claim 12, wherein the grooved shaft is a buttstock extension shaft configured to adjust at least one of a rifle's length of pull and a recoil pad angle of orientation.

14. An adjustable length rifle buttstock comprising:

a band clamp having at least two end portions;

a buttstock body having an outer surface defining a cavity for receiving the band clamp; a buttstock extension shaft having a plurality of grooves around its circumference at different points along its length and defining a plurality of ridges between the plurality of grooves, wherein the extension shaft is configured to telescope in and out of the cavity through the band clamp; a buttstock recoil pad attached to one end of the buttstock extension shaft;

a cam lever operatively coupled to the at least two end portions, the cam lever comprising:

an eccentric camming portion configured to pivot around a cam axis; an eccentric camming surface on the eccentric ramming portion configured to apply a clamping force on the at least two end portions when the earn eccentric camming portion is in a locked position;

a cam lever handle extending from the eccentric camming portion; and a locking feature extending from the eccentric camming portion in a direction perpendicular to the cam axis, wherein a portion of the locking feature extends into one of the plurality of grooves when in the locked position and remains clear of the plurality of ridges when in an unlocked position.

15. The adjustable length rifle buttstock of claim 14, wherein the outer surface of the buttstock body is contoured to define a cam lever groove for receiving a handle portion of the cam lever when the eccentric camming portion is in the locked position.

16. The adjustable length rifle buttstock of claim 15, wherein a handle portion of the cam lever conforms to the outer surface of the buttstock body when the eccentric camming portion is in the locked position.

17. A firearm including the adjustable length rifle buttstock of claim 15.

18. A firearm including the adjustable length rifle buttstock of claim 15, wherein a user can adjust at least one of the length of pull of the firearm and the buttstock recoil pad's angle of orientation by placing the eccentric camming portion in the locked position when the buttstock extension shaft is in a desired location.

* * * * *